US009975370B2

(12) United States Patent
Karrer Walker et al.

(10) Patent No.: US 9,975,370 B2
(45) Date of Patent: May 22, 2018

(54) MULTI-LAYER BODY AND METHOD FOR THE PRODUCTION THEREOF

(71) Applicant: OVD Kinegram AG, Zug (CH)

(72) Inventors: Reto Karrer Walker, Unterageri (CH); Andreas Schilling, Hagendorn (CH); Rene Staub, Hagendorn (CH); Christina Streb, Abtwil (CH); Christian Saxer, Wohlen AG (CH)

(73) Assignee: OVD KINEGRAM AG, Zug (CH)

( * ) Notice: Subject to any disclaimer, the term of this patent is extended or adjusted under 35 U.S.C. 154(b) by 0 days. days.

(21) Appl. No.: 15/308,865

(22) PCT Filed: May 7, 2015

(86) PCT No.: PCT/EP2015/060050

§ 371 (c)(1),
(2) Date: Nov. 4, 2016

(87) PCT Pub. No.: WO2015/169895

PCT Pub. Date: Nov. 12, 2015

(65) Prior Publication Data

US 2017/0066279 A1 Mar. 9, 2017

(30) Foreign Application Priority Data

May 7, 2014 (DE) ..... 10 2014 106 340

(51) Int. Cl.
*B42D 15/00* (2006.01)
*B41F 33/00* (2006.01)
(Continued)

(52) U.S. Cl.
CPC ..... *B42D 25/373* (2014.10); *B41M 1/28* (2013.01); *B41M 3/14* (2013.01); *B41M 3/144* (2013.01);
(Continued)

(58) Field of Classification Search
CPC ... B42D 25/29; B42D 2033/10; B42D 25/373
See application file for complete search history.

(56) References Cited

U.S. PATENT DOCUMENTS 4,943,093 A * 7/1990 Melling ..... D21F 11/00 283/70
7,880,943 B2 * 2/2011 Kittler, Jr. ..... G03H 1/0011 283/85
(Continued)

FOREIGN PATENT DOCUMENTS

DE 102008036480 2/2010
DE 102009033762 1/2011
(Continued)

*Primary Examiner* — Shin H Kim
(74) *Attorney, Agent, or Firm* — Hoffmann & Baron, LLP

(57) ABSTRACT

A method for the production of a multilayer body, in particular a security element, includes: a) producing a metal layer on a substrate; b) partial demetalization of the metal layer to form a first item of optical information in a first area of the multilayer body; c) applying a partial lacquer layer in a second area of the multilayer body to form a second item of optical information, wherein the partial lacquer layer extends at least partially beyond the metal layer; d) structuring the partial metal layer in the second area using the partial lacquer layer as mask.

46 Claims, 7 Drawing Sheets

(51) Int. Cl.

| | |
|---|---|
| ***B42D 25/373*** | (2014.01) |
| ***B41M 3/14*** | (2006.01) |
| ***B42D 25/43*** | (2014.01) |
| ***B42D 25/36*** | (2014.01) |
| ***B42D 25/328*** | (2014.01) |
| ***B42D 25/364*** | (2014.01) |
| ***B42D 25/382*** | (2014.01) |
| ***B42D 25/387*** | (2014.01) |
| ***B42D 25/435*** | (2014.01) |
| ***B42D 25/445*** | (2014.01) |
| ***B42D 25/378*** | (2014.01) |
| ***B42D 25/337*** | (2014.01) |
| ***B42D 25/21*** | (2014.01) |
| ***B41M 1/28*** | (2006.01) |
| ***B41M 5/00*** | (2006.01) |
| ***B44F 1/10*** | (2006.01) |

(52) U.S. Cl.

CPC ..... *B41M 3/148* (2013.01); *B41M 5/0047* (2013.01); *B41M 5/0058* (2013.01); *B42D 25/21* (2014.10); *B42D 25/328* (2014.10); *B42D 25/337* (2014.10); *B42D 25/36* (2014.10); *B42D 25/364* (2014.10); *B42D 25/378* (2014.10); *B42D 25/382* (2014.10); *B42D 25/387* (2014.10); *B42D 25/43* (2014.10); *B42D 25/435* (2014.10); *B42D 25/445* (2014.10); *B44F 1/10* (2013.01)

(56) References Cited

U.S. PATENT DOCUMENTS

| | | | | |
|---|---|---|---|---|
| 8,691,493 | B2 | 4/2014 | Brehm et al. | |
| 9,248,689 | B2 | 2/2016 | Hoffmuller et al. | |
| 2008/0238082 | A1* | 10/2008 | Vast ..... | G07D 7/1205 283/72 |
| 2009/0243278 | A1* | 10/2009 | Camus ..... | D21H 21/48 283/72 |
| 2009/0317595 | A1 | 12/2009 | Brehm et al. | |
| 2011/0003166 | A1 | 1/2011 | Brehm et al. | |
| 2011/0079997 | A1 | 4/2011 | Heim | |
| 2012/0038988 | A1 | 2/2012 | Staub et al. | |
| 2012/0189159 | A1 | 7/2012 | Vincent | |
| 2014/0227488 | A1 | 8/2014 | Brehm et al. | |

FOREIGN PATENT DOCUMENTS

| | | |
|---|---|---|
| WO | WO2006046216 | 5/2006 |
| WO | WO2006084686 | 8/2006 |
| WO | WO2008017362 | 2/2008 |
| WO | WO2009080262 | 7/2009 |
| WO | WO2009109343 | 9/2009 |
| WO | WO20110066634 | 1/2011 |

* cited by examiner

A)

B)

MULTI-LAYER BODY AND METHOD FOR THE PRODUCTION THEREOF

This application claims priority based on an International Application filed under the Patent Cooperation Treaty, PCT/EP2015/060050, filed on May 7, 2015, and German Application No. DE 102014106340.6, filed on May 7, 2014.

BACKGROUND OF THE INVENTION

The invention relates to a multilayer body and to a method for the production thereof.

Multilayer bodies as a security element can be taken as known from the state of the art and are widely used to protect bank notes, securities and identity documents against forgery or for the authentication of products. They are based on a combination of several functional layers, which may, for example, comprise optically variable elements (OVD=Optical Variable Devices), diffractive elements, partially metalized layers or printed features.

It is known to produce such multilayer bodies by the sequential application of individual layers, building up the desired layer sequence. In order to obtain multilayer bodies that are particularly secure against forgery, it is desirable to allow features of the individual layers to transition seamlessly into each other. In other words, the layers should be arranged as accurately as possible in register with each other.

By register or register accuracy is meant the accurately positioned arrangement of layers which are superimposed or lying next to each other relative to each other, maintaining a desired positional tolerance. The term "register" originates from the register marks or also control marks being used, by means of which the positional tolerance can be measured and monitored.

Where the multilayer body is built up sequentially, however, this cannot always be achieved since the methods used to produce each individual layer are subject to tolerances in terms of the position of the layers relative to each other. As a result, the desired seamless transitions between the features cannot be achieved reliably, which has a negative effect on the security against forgery and the optical appearance of such a multilayer body.

This applies in particular when different layers are to be arranged in each case in register with each other in different areas of the multilayer body.

SUMMARY OF THE INVENTION

The object of the present invention is therefore to specify a method for producing a multilayer body that makes it possible to produce a multilayer body with improved security against forgery. It is a further object of the present invention to specify a multilayer body which is particularly secure against forgery.

This object is achieved according to the invention with the subject-matter of claims 1 and 24.

Such a method for producing a multilayer body, in particular a security element, comprises the following steps:

a) producing a metal layer on a substrate;

b) partial demetalization of the metal layer to form a first item of optical information in a first area of the multilayer body;

c) applying a partial lacquer layer in a second area of the multilayer body to form a second item of optical information, wherein the partial lacquer layer extends at least partially beyond the metal layer;

d) structuring the partial metal layer in the second area using the partial lacquer layer as mask.

In this way, a multilayer body is obtained which comprises a substrate, a partial metal layer and a partial lacquer layer, and wherein the partial metal layer forms, in a first area, a first item of optical information, and the partial lacquer layer forms, in a second area, a second item of optical information and the partial lacquer layer is arranged in the second area in perfect register, i.e. without the previous tolerances mentioned above, with the partial metal layer.

A multilayer body which can be obtained in this way can be used as a security element, in particular for a security document, in particular a bank note, a security, an identity document, a visa document, a passport, a vignette, a certificate or a credit card.

The partial demetalization of the metal layer therefore takes place in several steps and can thus be carried out in different ways for the different areas of the multilayer body. This increases the design possibilities for the multilayer body.

Thus, for example, the demetalization can be carried out in the first area in register with a different layer from the second area. Particularly complex and attractive designs are thus possible.

By using the partial lacquer layer as a mask, it is made possible, in order to structure the metal layer in the second area, to arrange the two layers exactly in register with each other. It is important in particular here that the partial lacquer layer not only extends into those areas which are covered by the metal layer but also into the areas not covered by the metal layer. The partial lacquer layer therefore partially overlaps the metal layer, perpendicularly to a surface area spanned by the metal layer and the partial lacquer layer.

As an alternative, it is also possible to carry out, in step b), a partial demetalization of the metal layer to form a first and second area of the multilayer body and then to apply, in step c), a partial lacquer layer in the first and/or second area of the multilayer body to form a first item of optical information in the first area and/or a second item of optical information in the second area, wherein the partial lacquer layer extends at least partially beyond the metal layer into the first and/or second area. The final structuring of the metal layer therefore takes place, optionally, in both areas by means of the partial lacquer layer. Hereby, layer structures made of metal and lacquer which are arranged perfectly accurately in register and give a particularly attractive optical design are obtained in both areas.

By a use of the partial lacquer layer as a mask is meant here that, during the structuring of the metal layer, the latter is either selectively retained or selectively removed in those areas which are covered by the partial lacquer layer. During the structuring, a defined positional relationship between the two layers is therefore obtained, with the result that these are arranged accurately in register with each other, for example adjoining each other seamlessly for an observer.

The partial demetalization of the metal layer preferably takes place through etching. It is expedient if the partial lacquer layer is an etch resist or comprises an etch resist.

By an etch resist is meant a substance that is resistant to an etching agent and which can protect a substance that is sensitive to the etching agent from attack by the etching agent where the etch resist covers this substance.

In this embodiment, after the production of the two layers, an etching agent is therefore applied to the resulting layer stack which removes the metal layer where it is not covered by the partial lacquer layer.

The etch resist is preferably a lacquer, which can in particular comprise binders, dyes, pigments, in particular colored or non-colored pigments, effect pigments, thin-film layer systems, cholesteric liquid crystals and/or metallic or non-metallic nanoparticles. The partial lacquer layer thus not only fulfils a protective function during the structuring of the metal layer but can itself display a decorative effect. It is also possible for several different etch resists, for example resist lacquers with different colorations, to be used in order to produce further visual effects.

These resist lacquers can also be designed in such a way that they serve to indicate tampering when attempts are made to tamper with the security document. Thus, for example, it can be attempted, with organic solvents or oxidants, to alter or remove or render invisible an entry, such as for example an expiry date or a photograph. Against tampering attempts of this type, the resist lacquers can, for example, be designed to be soluble in alcohols, with the result that they dissolve when acted on by alcohol and the dye migrates, with the result that the printed image of the etch resist recognizably runs or blurs. Furthermore, such resist lacquers can comprise further substances which exhibit a visually recognizable color reaction, e.g. a color change, when acted on by particular chemicals. Such substances are known for example as "solvent reactive inks".

The etching agent used for structuring the metal layer depends on the composition of this layer or of this layer system. Sodium hydroxide, potassium hydroxide, sodium carbonate, tetramethylammonium hydroxide or sodium ethylenediamine tetraacetate are suitable for example.

Depending on the material of the metal layer or alloy, however, acidic etching media can also be used, such as for example sulfuric acid, hydrochloric acid, phosphoric acid or also strong oxidants, such as for example sodium persulfate, hydrogen peroxide, or also a temporal sequence of different etching media or also a combination of the above-named media.

For such etching agents, etch resists based on PVC (polyvinyl chloride), polyester resins or acrylates are suitable, for example, wherein typically further film-forming substances such as nitrocellulose can be mixed in.

The etching can be supported by mechanical agitation, for example by brushing, moving the etching bath or ultrasound treatment. Customary temperatures for the etching procedure are preferably between 15° C. and 75° C.

It is further expedient if, before the application of the partial lacquer layer in step c), the metal layer is partially demetalized in the second area. Then the metal layer is therefore only partially present in the second area, with the result that the partial lacquer layer partially extends over the metal layer and partially into regions in which the metal layer is not present. This ensures that the above-mentioned effect after the structuring of the metal layer by means of the partial lacquer layer can be achieved. The partial demetalization preferably takes place relatively roughly structured while finer structures are only introduced in step d).

The partial demetalization of the metal layer in the second area preferably takes place through etching. The etching agents and method parameters already described with reference to the partial demetalization in the first area can be used here.

It is possible, in the second area, for an etching agent, in particular a base, to be printed onto the metal layer, in particular by flexographic printing or intaglio printing or screen printing. The etching agent therefore only comes into contact with the metal layer in the areas to be removed, with the result that no protective lacquers, resists, masks or the like are necessary.

It is further possible, before the etching, for a photoresist to be applied to the second area and to be exposed using an exposure mask.

During exposure to a particular wavelength range, a photoresist alters its chemical and/or physical properties, with the result that the different properties of the exposed and unexposed areas can be utilized for the selective removal of the photoresist in one of the areas. For example, when it is exposed, the solubility of the photoresist changes with respect to a solvent which can be used after the exposure to develop the photoresist. In the case of a positive photoresist, in the development step which follows the exposure, the exposed area is selectively removed; in the case of a negative photoresist, the unexposed area is removed.

Suitable positive photoresists are, for example, AZ 1518 or AZ 4562 from AZ Electronic Materials based on phenolic resin/diazoquinone. Suitable negative photoresists are for example AZ nLOF 2000 or ma-N 1420 from micro resist technology GmbH based, for example, on cinnamic acid derivatives. These can preferably be exposed by irradiation with light in a wavelength range from 250 nm to 440 nm. The required dose depends on the respective layer thicknesses, the wavelength of the exposure and the sensitivity of the photoresist.

For the development of this photoresist, for example tetramethylammonium hydroxide is suitable. The development preferably takes place at temperatures of from 15° C. to 65° C. for a preferred development time of from 2 seconds up to a few minutes. Here too the development procedure and the accompanying local removal of the photoresist can again be supported by mechanical agitation, such as for example brushing, wiping, exposure to a flow of the developing medium or ultrasound treatment.

The photoresist can also contain in particular binders, dyes, pigments, in particular colored pigments, effect pigments, thin-film layer systems, cholesteric liquid crystals and/or metallic or non-metallic nanoparticles in order to produce additional decorative effects.

It is expedient for the exposure mask to be formed by a further partial lacquer layer applied to the substrate before the application of the metal layer. Therefore, the exposure then takes place from the substrate side. This lacquer layer serving as exposure mask can be transparent, translucent or opaque to visible light but it must comprise constituents such as pigments or the like which block the exposure wavelengths (e.g. in the ultraviolet spectral range) to the extent that a masking function or a contrast difference can be achieved during the exposure.

Expediently, the further partial lacquer layer comprises a protective lacquer. By protective lacquer is meant a substance which absorbs in a wavelength range used for the exposure of the photoresist. During exposure, the partial layers are irradiated over the entire surface with light in this wavelength range, preferably perpendicularly to the plane of the layer. Customary wavelengths used for the exposure are, for example, 250 nm to 420 nm. The exposure preferably takes place at a dose from 10 mJ/cm$^2$ to 500 mJ/cm$^2$. The exposure times are obtained from the sensitivities of the materials used and the output of the available light source.

Where the further partial lacquer layer is present, less light of this wavelength therefore reaches the photoresist, with the result that, in a subsequent etching procedure, the metal layer can be structured in register with the further partial lacquer layer.

Of course, it is also possible as an alternative for an external, separate exposure mask to be used which is laid on the photoresist.

It is further preferred that, before the etching, an etch resist is applied partially to the second area and is removed again after the etching. The etching then takes place as already described in the case of the structuring of the first area.

Alternatively it is also possible for the partial demetalization of the metal layer to take place in the second area through lift-off.

In the lift-off process, a partial layer made of a washcoat is applied to the substrate before the application of the metal layer and after the application of the metal layer it is removed by means of a solvent. The washcoat must therefore be soluble in the solvent.

For reasons of environmental protection, water is preferably used as solvent. Suitable washcoats are composed, for example, on the basis of polyvinyl alcohol (PVA) or polyvinylpyrrolidone (PVP) and can additionally contain fillers which facilitate the later removal of the washcoat.

The removal of the washcoat takes place in a solvent bath or by spraying with solvent, preferably at temperatures from 15° C. to 65° C. As also in the case of etching, the removal of the washcoat can be mechanically supported, for example by brushing, moving the solvent bath, spraying or ultrasound treatment.

In areas where the metal layer is applied to the washcoat, the metal layer is removed together with the washcoat. The metal layer therefore only remains in areas in which it does not overlap with the partial layer of washcoat. A negative with respect to the overlapping areas thus forms.

It is further possible for the partial demetalization of the metal layer in the second area to take place through laser ablation. This makes it possible in particular to produce individualized multilayer bodies which differ in the shape of their partial metal layers in a simple manner. For example, personalization information can thereby be introduced into the multilayer body.

A further possibility for the partial demetalization of the metal layer in the second area is the application, in particular printing, of a partial oil layer before the application of the metal layer.

Where the partial oil layer is applied, the metal does not adhere to the substrate when the metal layer is applied, for example by vapor deposition or sputtering, with the result that the desired structuring is already achieved during the production of the metal layer.

As an alternative to performing the partial demetalization of the metal layer in several steps as described previously, it is also possible to carry out the partial demetalization of the metal layer in the first and second area in a common workstep. For this, first of all a comparatively extensive partial demetalization of the metal layer on the substrate is carried out in order to create the first and second area as separate metalized areas. The remaining metalized first and second areas are, for example, approximately 1 $cm^2$ to 5 $cm^2$ in size.

Then, a further partial demetalization of the metal layer takes place in the first and second area as was previously described only with reference to the second area. That is, with the aid of a partial lacquer layer, for example an etch resist or a photoresist or a lift-off lacquer, the large-area first and second areas are finely structured again over a smaller area. Here, as described previously with respect to the second area, the partial lacquer layer can overlap the metal layer of the first and/or second area completely or only partially. The partial lacquer layer not only extends into those areas which are covered by the metal layer of the first and/or second area but also into the areas not covered by the metal layer. The partial lacquer layer therefore overlaps the metal layer of the first and/or second area completely or only partially, perpendicularly to a surface area spanned by the metal layer and the partial lacquer layer.

In this way, the first area and the second area can also be structured largely independently of each other, wherein, however, fewer process steps are required.

Depending on the position of the partial lacquer layer relative to the position of the metal layer of the first and/or second area, different optical appearances of the resulting finely structured metal layer can be produced in the first and second area.

It is further preferred if the substrate is or comprises a replication layer with a surface relief formed in a surface facing the metal layer. The replication layer can consist of a thermoplastic, i.e. thermally curable or dryable replication lacquer or a radiation-curable, in particular UV-curable replication lacquer or a mixture of such lacquers.

The surface relief introduced into the replication layer preferably forms an optically variable element, in particular a hologram, Kinegram® or Trustseal®, a preferably linear or crossed sinusoidal diffraction grating, a linear or crossed single- or multilevel rectangular grating, a zero-order diffraction structure, an asymmetrical sawtooth relief structure, a blazed grating, a preferably isotropic or anisotropic matt structure, or a light-diffracting and/or light-refracting and/or light-focusing micro- or nanostructure, a binary or continuous Fresnel lens, a binary or continuous Fresnel freeform surface, a microprism structure or a combination structure thereof.

By such structures or combinations thereof, a variety of optical effects can be achieved which, in addition, are difficult to imitate and cannot be copied or are difficult to copy with customary optical copying methods, with the result that a multilayer body which is particularly secure against forgery results.

It is advantageous if the surface relief comprises a partial area with a depth-to-width ratio of 0.15 to 1.5, preferably of 0.2 to 0.5, which is complementary to the first item of optical information.

Through the depth-to-width ratio, the transparency of a metal layer applied to the surface relief can be varied. This differently transparent metal layer can therefore subsequently itself be used as exposure mask in order to structure a further layer. The structuring thus takes place in register with the differently transparent areas of the metal layer and thus with the different areas of the surface relief, with the result that seamless transitions form between different areas of the surface relief and the further layer.

It is advantageous if, for the partial demetalization of the metal layer in the first area, a photoresist is applied to the metal layer and is exposed from the side of the substrate and the metal layer is then partially demetalized by etching.

The photoresists and etching agents correspond to the variants described above. In this way, the metal layer itself is structured in register with the surface relief.

Preferably, at least one further partial lacquer layer is applied to the multilayer body to form at least one further item of optical information. Hereby, complex and attractive designs can be realized which make possible the production of a multilayer body which is particularly secure against forgery.

Expediently, a layer thickness of the partial lacquer layer and/or of the at least one further partial lacquer layer is 0.2 μm to 10 μm, preferably 0.3 μm to 3 μm, further preferably 0.5 μm to 1.5 μm.

It is expedient if the at least one further partial lacquer layer comprises colorants, in particular colored or non-colored pigments and/or effect pigments, thin-layer film systems, cholesteric liquid crystals, dyes and/or metallic or non-metallic nanoparticles.

Hereby, a variety of optical effects can be achieved which are supplemented by the appearance of the metal layer and of the partial lacquer layer as well as the surface relief to form the desired overall decoration.

It is further expedient if the colorants can be excited in the ultraviolet spectrum to fluorescence and/or phosphorescence, in particular in the visible spectrum. Furthermore, it is expedient if the colorants can be excited in the infrared spectrum by means of the anti-Stokes effect to emission in the visible spectrum. Agents can also be added which have a machine-verifiable emission spectrum which is only partially or not at all in the visible spectrum.

Hereby, further items of information can be introduced which are not visible in normal daylight and only appear under suitable illumination. Such items of information can also be formed as machine-readable items of information which do not disrupt the overall decoration when observed in daylight. Also in this way, the security against forgery of the multilayer body can be improved.

The partial lacquer layer and/or the at least one further partial lacquer layer is preferably applied by printing, in particular by intaglio printing, flexographic printing, offset printing, letterpress printing, screen printing, pad printing, ink-jet printing and/or laser printing.

It is further expedient if the partial lacquer layer and/or the at least one further partial lacquer layer is radiation-cured, in particular by UV or electron-beam radiation.

Preferably, furthermore, at least one individualization feature is applied to the multilayer body, in particular by ink-jet and/or laser printing. Thereby, for example, the multilayer body can be allocated to a particular security document, which likewise increases the security against forgery.

It is further preferred if the substrate comprises a wax layer and/or a release layer and/or a protective layer, in particular a protective lacquer layer.

Wax and release layers can serve for the releasable arrangement of the multilayer body on a carrier from which the multilayer body is released before it is mounted, for example, on a security document.

Furthermore, the layer structure can also be designed in such a way that release from the carrier is prevented. The multilayer body remains on the carrier, or the carrier is part of the multilayer body, which is transferred onto the security document. In a case of this kind, the wax layer and the release layer are dispensed with since no release needs to be ensured. On the other hand, additional layers can be introduced which ensure an increased adhesion of the intermediate layer between carrier and replication layer.

Furthermore, the wax layer can be only partially present, with the result that a release can take place only locally while, in other areas, no release takes place. The application onto a security document takes place in turn together with the carrier. Structures of this type are used, for example, in order to indicate tampering attempts. If it is attempted to remove the security element from the security document, the release layer and/or protective layer and/or replication layer remain on the security document in those areas with locally applied wax layer, while in any areas without wax layer the layer composite can be removed from the substrate together with the carrier. The security feature is recognizably damaged by this tampering attempt.

Furthermore, the multilayer body can be transferred onto a substrate which is only processed to form a security document in a later step. Thus, the multilayer body can, for example, be applied to a transparent, translucent or opaque plastic ply, in particular made of polycarbonate or polyester, polypropylene or polyethylene, such as for example Teslin®, which is only joined to further plastic plies to form a document body in further processing steps, for example by lamination and/or back injection molding. Typical thicknesses of the plastic plies are between 25 μm and 150 μm, preferably between 50 μm and 100 μm. The plies can be transparent or also contain fillers. Furthermore, they can be designed such that they can be blackened by means of a laser beam.

The protective layer, which can also be formed from several layers, preferably forms a visible face of the multilayer body, with the result that the latter is protected against mechanical or chemical damage. For example, acrylate or polyester with additional film-forming components, such as for example nitrocellulose, UV-curing systems, chemically curing systems, for example based on isocyanate, can be used as protective lacquer.

Preferably a layer thickness of the replication layer and/or of the protective lacquer layer is 0.3 μm to 3 μm, preferably 0.5 μm to 1.5 μm. Preferably a layer thickness of the wax layer and/or of the release layer is 0.01 μm to 0.3 μm, preferably 0.1 μm to 0.2 μm. Alternatively to the wax layer and/or the release layer, layers made of silicone or an acrylic polymer/acrylic copolymer can also be used. The release layer can also be part of the protective lacquer layer.

It is further expedient if the substrate comprises a releasable carrier ply, in particular made of PET, PEN or PP. This protects the multilayer body before it is mounted in its final place of use and can serve as mechanical stabilization during the manufacture of the multilayer body.

Expediently, a layer thickness of the carrier ply is 5 μm to 75 μm, preferably 10 μm to 50 μm, further preferably 12 μm to 25 μm.

The partial metal layer preferably consists of aluminum, copper, chromium, silver and/or gold and/or an alloy thereof. The partial metal layer can also consist, in areas, of different metals in order to produce particular optical effects.

Expediently, a layer thickness of the metal layer is 10 nm to 200 nm, preferably 10 nm to 50 nm, further preferably 15 nm to 35 nm.

It is further advantageous if, in the first area, an in particular transparent protective lacquer layer, in particular made of PVC, PET, acrylate, nitrocellulose, cellulose acetobutyrate or mixtures thereof, is arranged on the partial metal layer. However, the protective layer can also consist of a UV- or electron beam-curing lacquer.

Such a protective lacquer layer can protect the metal layer in the first area during the structuring of the second area, with the result that the structures introduced first of all in the first area are retained.

Expediently, a layer thickness of the protective lacquer layer is 0.2 μm to 10 μm, preferably 0.3 μm to 3 μm, further preferably 0.5 μm to 1.5 μm.

It is further advantageous if the first and/or second and/or further item of optical information is formed in the shape of at least one motif, pattern, in particular a guilloche pattern, symbol, image, logo or alphanumeric character, in particular numbers and/or letters.

The items of optical information can also supplement each other to form such a motif, pattern, symbol, image, logo or to form alphanumeric characters, in particular numbers or letters. A graphical element produced in this way, which forms through the interaction of several layers, is particularly difficult to reproduce and is therefore particularly secure against forgery.

It is further advantageous if the first and/or second and/or further item of optical information is formed in the shape of a one- or two-dimensional line and/or dot grid, wherein the line and/or dot grid preferably has a grid spacing of less than 300 μm, preferably of less than 200 μm and of more than 25 μm, preferably more than 50 μm.

Transformed line grids are also possible here, for example with wavy lines, which can also have a variable line width. The dots of a dot grid can have any geometry and/or size and do not need to be circular disc-shaped. For example, dot grids made of triangular, rectangular, any polygonal or star-shaped dots or those formed in the shape of symbols are also possible. The dot grid can also be built up from dots of different sizes and/or different shapes. Precisely when such a grid interacts with a graphical element in the respectively other layer or in the respectively other layer system can further graphical effects, such as for example halftone images, be produced.

Such grids affect other graphical elements which are superposed by the grid but are themselves no longer perceived as such by the naked human eye.

The first and/or second and/or further item of optical information preferably comprises at least one machine-readable feature, in particular a barcode. This permits a rapid and simple authentication of the multilayer body which can also take place, for example, with a mobile device such as a mobile telephone, PDA or the like.

It is furthermore expedient if, on the side of the multilayer body facing away from the substrate, an adhesive layer, in particular made of PVC, polyester, acrylate, cellulose ester, natural resin, ketone resin, polyamide, polyurethane, epoxy resin or mixtures thereof, is arranged. This serves to join the multilayer body to an article or document for the authentication of which the multilayer body is to be used.

It is expedient if a layer thickness of the adhesive layer is 0.5 μm to 25 μm, preferably 1 μm to 15 μm. The adhesive layer can also be formed from several layers, in particular made of different materials, wherein previously mentioned layer thickness values relate to the total thickness of the adhesive layer(s).

Further layers, which for example improve the adhesion of the intermediate layer or increase the stability, can be applied before the application of the adhesive to the multilayer body. For increasing the stability, chemically cross-linking layers or radiation-curing lacquers are suitable in particular.

Furthermore, it is possible not to apply any adhesive. A bond with the substrate on which the feature is to be applied can be achieved, for example, in that a UV-curing adhesive is printed onto the substrate, the multilayer body is pressed onto the adhesive and the UV-curing adhesive is cured by means of UV irradiation. The carrier film made of PET can then be pulled off (cold foil or cold stamping).

Furthermore, at least in partial areas, reflective layers made of a highly-refractive material (HRI=High Refractive Index) can be applied. Examples of highly-refractive materials are zinc sulfide or titanium dioxide which are usually applied by vapor deposition or sputtering. Such layers can be applied before the application of the metal layers or after the partial metallization thereof or after printing processes. If these layers are located directly on optically diffractive structures, further optical effects can thus be achieved which further increase the security of the multilayer body.

Such optically diffractive structures can be, for example, zero-order diffraction structures with which a color change can be realized in direct reflection (zero-order) at a rotation of the OVD by 90 degrees in the plane. Here, for example, an item of information "OK" appears green on a red background in the normal observation position; after rotation of the OVD in particular by 90 degrees in the plane, the "OK" appears red on a green background (other color combinations are also possible). For the item of information and the background, typically the same zero-order diffraction structures are used, once in the 0 degree orientation and once in the 90 degree orientation. The parameter ranges typically used here are:

- ZnS as highly-refractive material with a layer thickness in the range of from 40 nm to 100 nm.
- Profile shape of the diffraction structure: linear binary rectangular grating or linear sinusoidal grating
- Spatial frequency range for the zero-order diffraction structure: 2500 lines/mm to 3100 lines/mm.
- Structure depth for the zero-order diffraction structure: in the range of from approx. 100 nm to 200 nm This visual effect is characterized by a high degree of security against forgery and a simple verifiability.

BRIEF DESCRIPTION OF THE DRAWINGS

The invention is now explained in more detail with reference to embodiment examples. There are shown in.

DETAILED DESCRIPTION OF THE INVENTION

Figure 1:
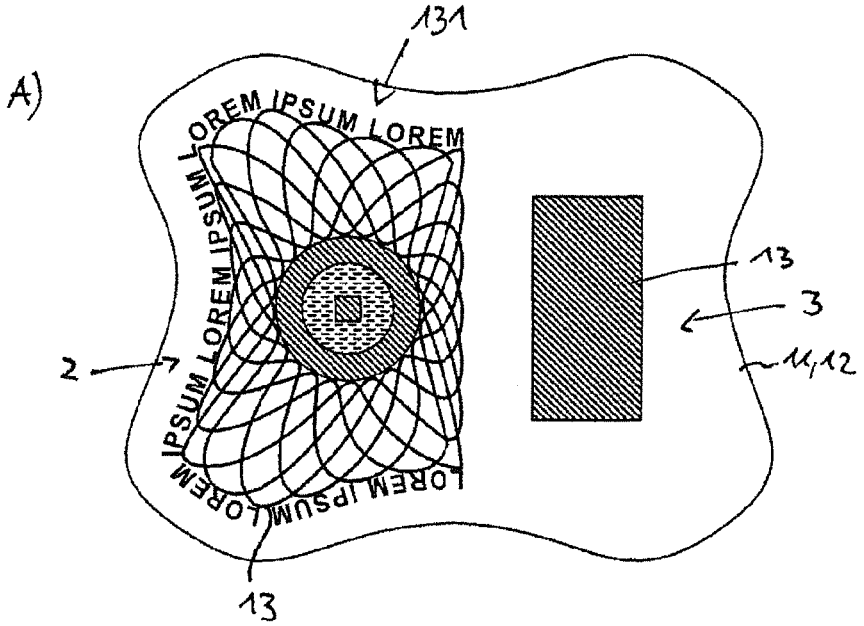
FIG. 1A-B A first intermediate product during the carrying out of an embodiment example of a method for producing a multilayer body in schematic top view and sectional representation.
Figure 1:
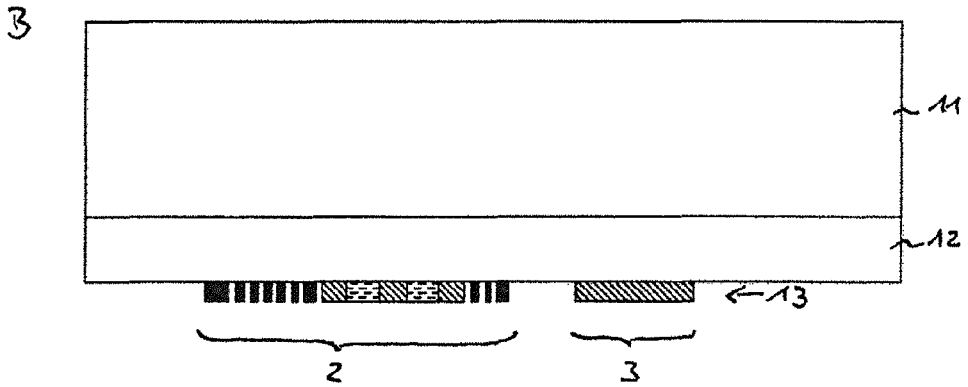

For the production of a multilayer body labeled as a whole with 1, which can be used as security element for bank notes, securities, identity documents, visa documents, certificates, tickets or protected product packaging, first of all a carrier layer 11 is provided with a transfer ply 12.

The carrier layer 11 preferably consists of polyester, in particular PET and has a layer thickness of from 6 μm to 75 μm, preferably 12 μm to 25 μm. The transfer ply 12 can comprise a wax layer, a release layer, a protective lacquer layer and a replication layer, which forms the surface of the transfer ply 12 facing away from the carrier layer 11.

Preferably a layer thickness of the replication layer and/or of the protective lacquer layer is 0.3 μm to 3 μm, preferably 0.5 μm to 1.5 μm. Preferably a layer thickness of the wax layer and/or of the release layer is 0.01 μm to 0.3 μm, preferably 0.1 μm to 0.2 μm. Alternatively to the wax layer and/or the release layer, layers made of silicone or an acrylic polymer/acrylic copolymer can also be used. The release layer can also be part of the protective lacquer layer.

The replication layer consists, for example, of a thermoplastic or a radiation-curable or temperature-curable replication lacquer. Diffractive structures are then formed in the replication layer, for example by stamping with a metallic stamping tool.

The surface relief introduced into the replication layer preferably forms an optically variable element, in particular a hologram, Kinegram® or Trustseal®, a preferably linear or crossed sinusoidal diffraction grating, a linear or crossed single- or multilevel rectangular grating, a zero-order diffraction structure, an asymmetrical relief structure, a blazed grating, a preferably isotropic or anisotropic matt structure, or a light-diffracting and/or light-refracting and/or light-focusing micro- or nanostructure, a binary or continuous Fresnel lens, a binary or continuous Fresnel freeform surface, a microprism structure or a combination structure thereof.

In addition or as an alternative to such structures, the surface relief forms, in a first area 2 of the multilayer body, a first item of optical information which is formed by structures with a depth-to-width ratio of from 0.15 to 1.5, preferably from 0.2 to 0.5, and a spatial frequency preferably of at least 1000 lines/mm to 5000 lines/mm.

After the provision of the carrier layer 11 and transfer ply 12, as shown in FIG. 1, a metal layer 13 is produced on the replication layer of the transfer ply 12, which can take place for example by vapor deposition on a substrate, not shown. The vapor deposition preferably takes place in a vacuum by thermal evaporation, by means of electron-beam evaporation or also by means of sputtering.

The metal layer 13 can preferably consist of aluminum, copper, chromium, silver and/or gold and/or an alloy thereof. The partial metal layer can also consist, in areas, of different metals in order to produce particular optical effects.

Expediently, a layer thickness of the metal layer 13 is 10 nm to 100 nm, preferably 15 nm to 35 nm, in particular when aluminum is used.

Then, the metal layer 13 is partially removed by means of known methods, for example by the partial application of an etch resist after the vapor deposition and subsequent etching including removal of the etch resist; by the partial application of a washcoat before the metalization and washing off (lift-off) after the metalization; or by the partial application of a photoresist after the metalization and then exposure and subsequent removal of the exposed or unexposed components of the photoresist depending on the type (positive, negative) of the photoresist.

Through the depth-to-width ratio of the surface relief of the replication layer in the first area 2, the transparency of the metal layer 13 applied to the surface relief can be varied. This different transparency can therefore subsequently itself be used as exposure mask in order to structure a photoresist applied to the metal layer 13. During the subsequent etching, the metal layer 13 in the first area 2 therefore remains in register with the first item of optical information 131 predefined in the replication layer.

Alternatively, the substrate is not metalized over all of its surface, rather the metal layer 13 is partially produced in particular in the second area 3 of the multilayer body 1. Various methods are known for this, such as for example shielding by means of a concurrent mask or printing with an oil which prevents the deposition of the metal layer in the vapor deposition process.

Therefore, the structuring of the metal layer 13 preferably takes place separately for the first area 2 and the second area 3, wherein in the second area preferably only a rough structuring is carried out. However, the structuring can also take place in a common workstep.

Figure 2:
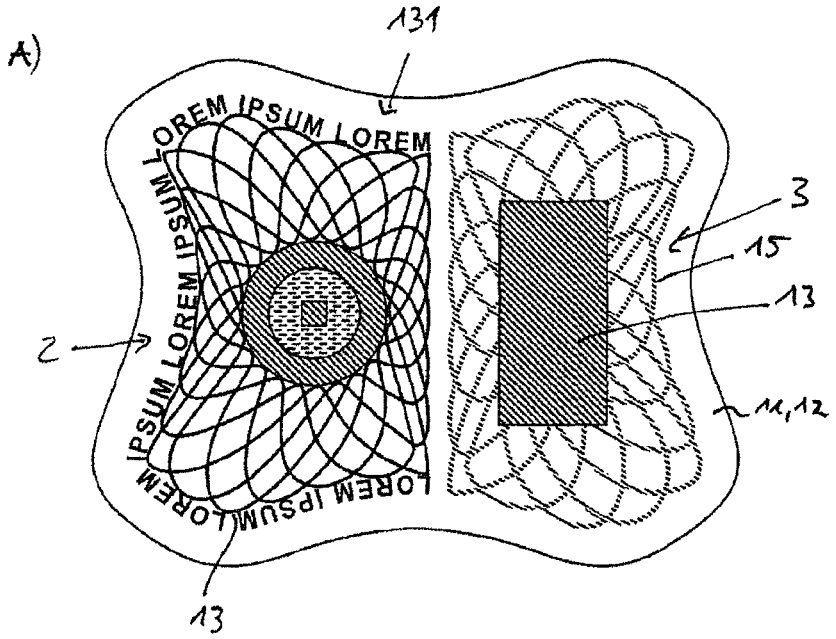
FIG. 2A-B A second intermediate product during the carrying out of an embodiment example of a method for producing a multilayer body in schematic top view and sectional representation.
Figure 2:
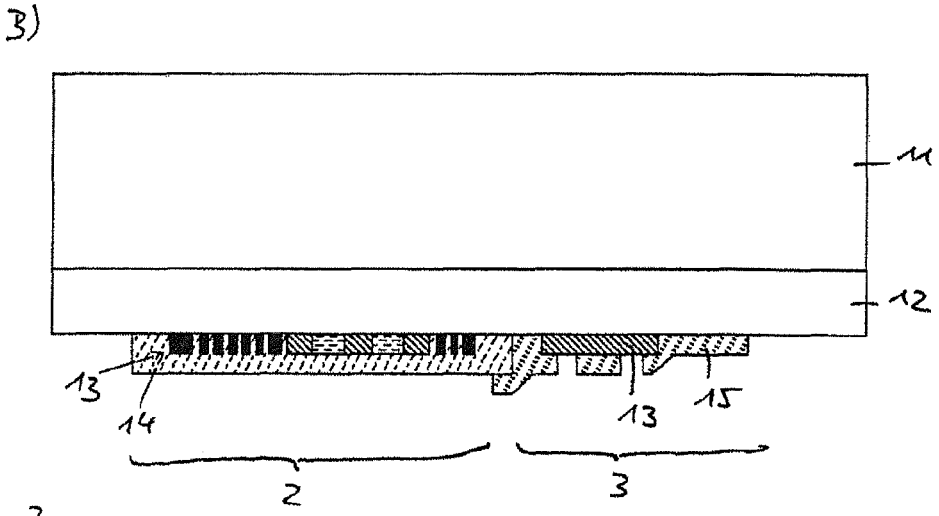

As shown in FIG. 2, in the next method step a transparent protective lacquer 14 is applied to the metal layer 13 in the first area 2. In the following etching processes, this protects the already completely structured metal layer 13 in the first area 2. The layer thickness of the protective lacquer layer 14 is 0.2 μm to 10 μm, preferably 0.5 μm to 1.5 μm.

In the second area 3, a partial lacquer layer 15 is printed on such that it extends beyond the metal layer 13 in this area, but also leaves parts of the metal layer 13 uncovered. The lacquer layer 15 forms a second item of optical information 151, in the example shown a guilloche pattern of fine lines. The printing of the lacquer layer 15 can also overlap areas of area 2 (not shown here).

In the example shown in the figures, the lacquer layer 15 acts as an etch resist and preferably comprises a lacquer, which in particular comprises binders, dyes, pigments, in particular colored or non-colored pigments, effect pigments, thin-film layer systems, cholesteric liquid crystals and/or metallic or non-metallic nanoparticles.

Suitable lacquers are formulated for example on the basis of PVC, polyester or acrylates. The partial lacquer layer 15 thus fulfils not only a protective function during the structuring of the metal layer 13 but can itself display a decorative effect. It is also possible for several different lacquers, for example with different colorations, to be used in order to produce further visual effects.

Figure 3:
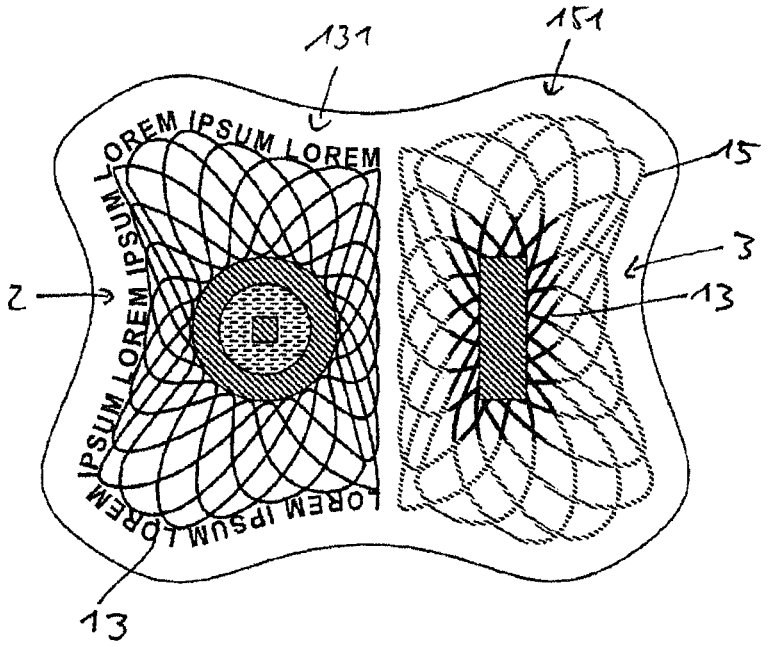
FIG. 3A-B A third intermediate product during the carrying out of an embodiment example of a method for producing a multilayer body in schematic top view and sectional representation.
Figure 3:
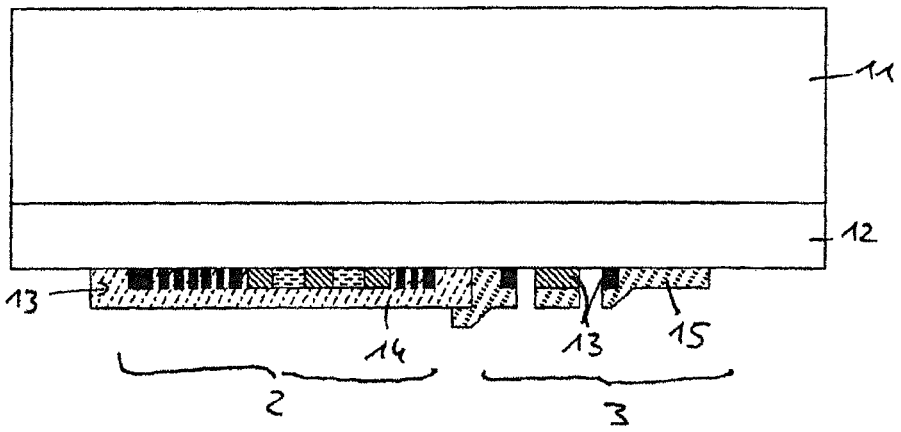

After the application and curing of the lacquer layers 14 and 15, a further etching process takes place. This leads to the intermediate product shown in FIG. 3. In the first area 2, the structure of the metal layer 13 is retained because of the protective lacquer layer 14. In the second area 3, the metal layer 13 is removed where it is not covered by the partial lacquer layer 15.

As can be seen in FIG. 3A, this leads to the line patterns of the partial lacquer layer 15, seen from the visible face of the multilayer body, that is from the direction of the carrier ply 11, being recognizable where they were not applied to the metal layer 13. Where the lacquer layer 15 was applied to the metal layer 13, the metal layer 13 remains and the line pattern of the lacquer layer 15 can be recognized as a metal structure. The line pattern of the second item of optical information 151 therefore transitions seamlessly between colored lacquer and metal.

Figure 4:
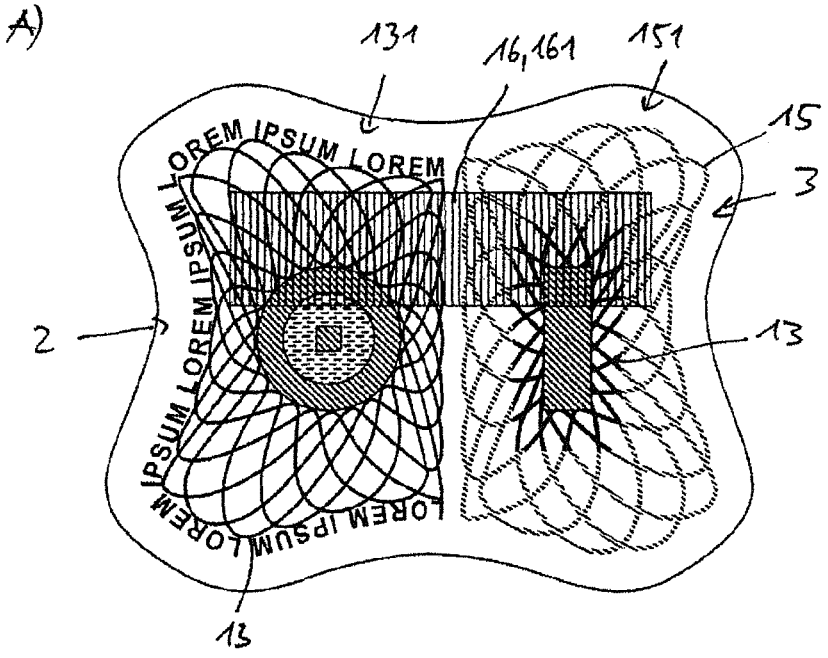
FIG. 4A-B A fourth intermediate product during the carrying out of an embodiment example of a method for producing a multilayer body in schematic top view and sectional representation.
Figure 4:
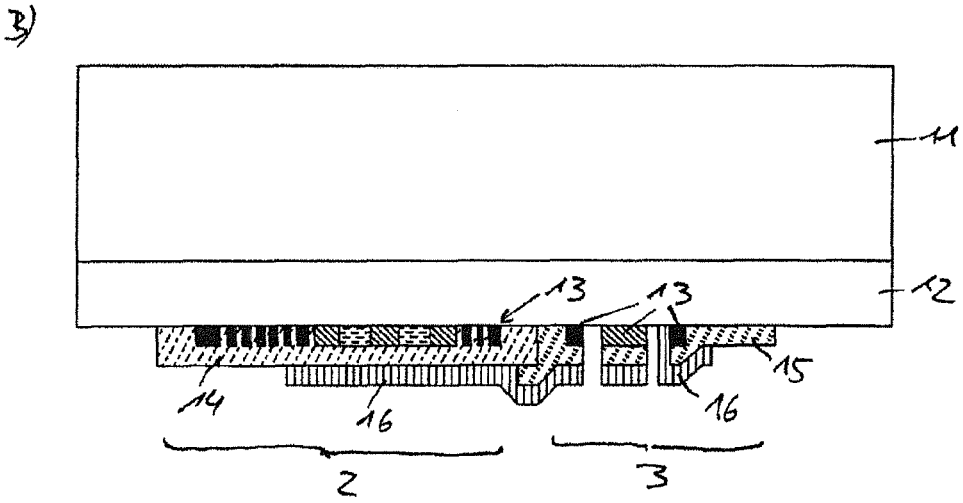

Then, a further partial lacquer layer 16 is applied which forms a further item of optical information 161. This is represented in FIG. 4. The lacquer layer 16 overlaps both the first area 2 and the second area 3. For the lacquer layer 16, a lacquer is used the dyes or pigments of which cannot be recognized in the visual spectrum but which can be excited to fluorescence and/or luminescence by UV irradiation. A suitable lacquer is composed, for example, from acrylate with nitrocellulose as film-former and with UV-active pigment mixed in. Such pigments can be, for example, Lumilux® pigments from Honeywell. Furthermore, it is also possible to provide colorless or pigmented printing lacquers for different printing processes, such as for example intaglio printing, flexographic printing or offset printing, with pigments. Such lacquers are offered print-ready, for example, by Luminescence.

The further item of optical information 161 can therefore only be recognized under a UV light source and serves as an additional security feature. Furthermore, the emission of the fluorescence can be different depending on the wavelength of the UV light source. Thus, for example, it can be red on excitation at 365 nm and green on excitation at a wavelength of 254 nm and thus serve as a further security feature. For example, the further item of optical information 161 can represent a machine-readable pattern such as a barcode.

Figure 5:
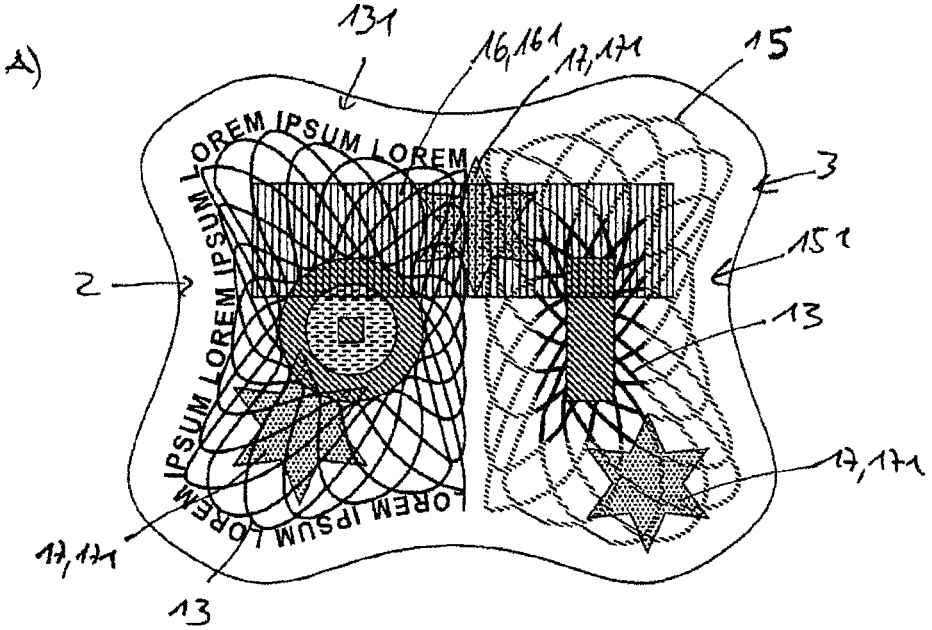
FIG. 5A-B A fifth intermediate product during the carrying out of an embodiment example of a method for producing a multilayer body in schematic top view and sectional representation.
Figure 5:
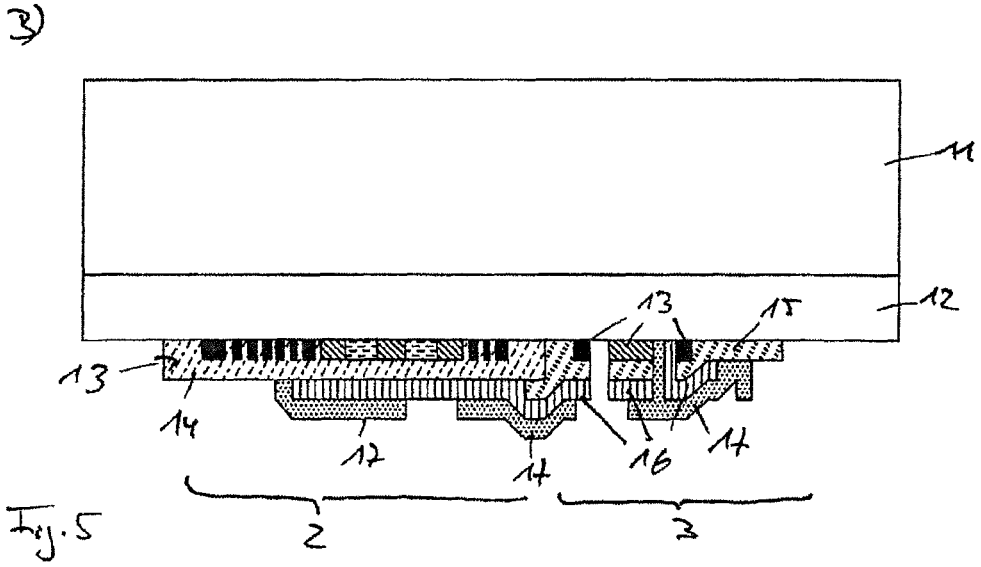

As FIG. 5 shows, a further partial lacquer layer 17 can now be applied. For this, a lacquer is again used the colorants of which can be recognized by the human eye. The further partial lacquer layer 17 forms a further item of optical information 171, here a pattern of stars, which partially overlies the items of optical information 131, 151 and 161 and forms a background for them.

The lacquer layers 15, 16, 17 are preferably applied by intaglio printing, flexographic printing, screen printing, pad printing, offset printing, letterpress printing, ink-jet printing and/or laser printing. The layer thickness of the lacquer layers 15, 16, 16 is 0.3 μm to 3 μm, preferably 0.5 μm to 1.5 μm.

After the printing, radiation-curing can take place, in particular by UV irradiation at wavelengths of from 200 nm to 415 nm. Before the individual printing steps, primers can also be applied to improve the layer adhesion. For this, lacquers based on PVC, polyester or acrylates in layer thicknesses of from 0.01 μm to 1 μm, preferably from 0.02 μm to 0.2 μm are suitable, for example.

Finally, an adhesive layer 18 is also applied to the printed layers, with which the finished multilayer body 1 can be fixed onto a security document, for example. For example PVC, polyester, acrylates, cellulose ester, natural resins, ketone resins, polyamide, polyurethane, epoxy resins or mixtures thereof, are suitable as adhesive. The layer thickness of the adhesive layer is 1 μm to 25 μm, preferably 1 μm to 15 μm.

Figure 6:
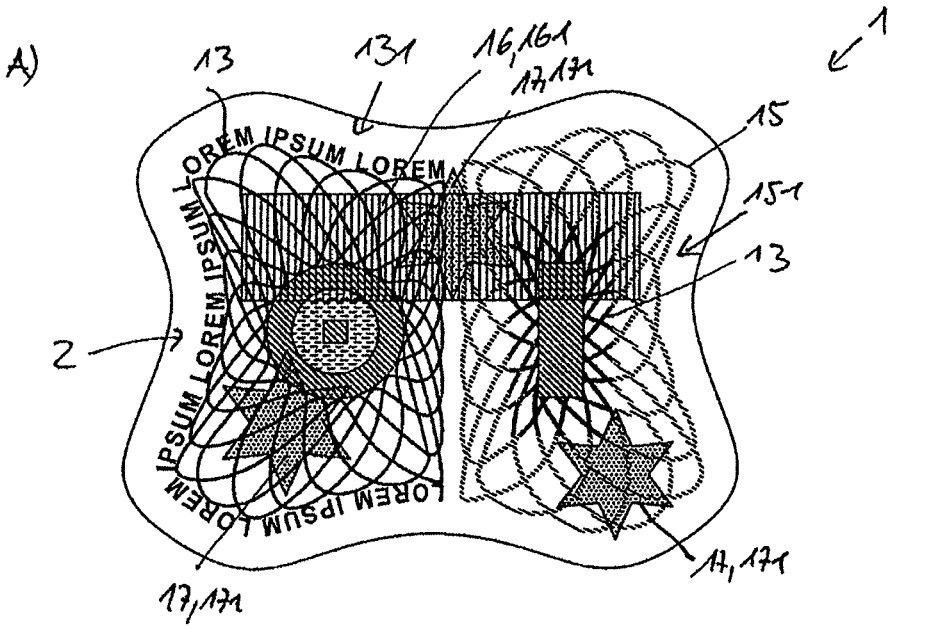
FIG. 6A-B A multilayer body manufactured by means of an embodiment example of a method for producing a multilayer body in schematic top view and sectional representation.
Figure 6:
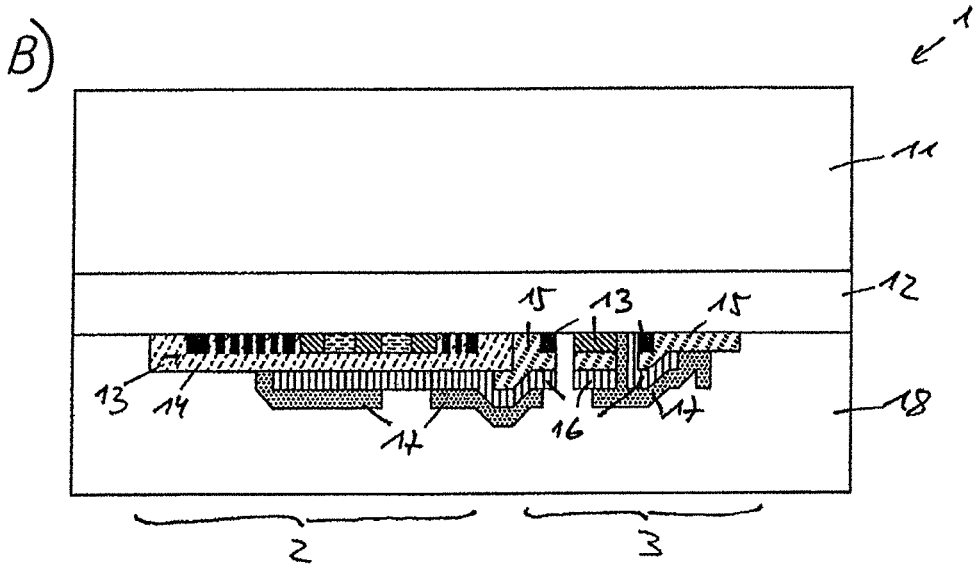

In FIG. 6A, it can now be recognized how the individual layers of the multilayer body 1 interact. The background of the decoration is formed by the star-shaped patterns of the lacquer layer 17. Over these lies the item of optical information 161 which is only visible under UV irradiation and is formed by the lacquer layer 16. The foreground of the decoration is shaped by the guilloche lines of the first item of optical information 131 and the second item of optical information.

In addition to these guilloche lines, the first and second items of optical information can also form further features. As can be seen from FIG. 6A, the first item of optical information 131 also comprises a circumferential microtext with contrast inversion based on asymmetrical structures. This contrast inversion can be implemented, for example, with blazed or so-called sawtooth structures. Here, one and the same blazed structure is used, for example, for the outline and the fill of the microtext, wherein these are mounted rotated by 180° with respect to each other. A typical light-dark contrast inversion thereby results: in the normal observation position, for example, the fill appears light and the outline dark; after a 180° rotation of the OVD in the plane, the outline now appears light and the fill dark. This visual effect is characterized by a high degree of security against forgery and a simple verifiability. Typical parameter values for the blazed structures to be used are numbers of lines in the range of from 500 lines/mm to 1500 lines/mm and structure depths in the range of from 200 nm to 500 nm. The contrast inversion can be realized with such colored blazed structures or also with rougher achromatic blazed structures.

In the centre of the guilloche lines, further security features are arranged which are formed by the metal layer 13 interacting with the replication layer. These can be, for example, micro- or nanostructures, DACs (diffractive area codes), diffractive fine-line effects (e.g. transformations, conversions, pump effects, or the like) based on colored or achromatically acting microstructures, binary or continuous Fresnel freeform surfaces, image-flip effects, or also other security structures which can either be recognized with the naked eye, or with simple additional aids (e.g. a magnifier), or with special aids (e.g. a microscope), or purely machine-readable security structures.

Further features, such as for example diffractive fine-line effects (e.g. transformations, conversions, pump effects, or the like) based on colored or achromatically acting microstructures, binary or continuous Fresnel freeform surfaces, image-flip effects, or also other security structures which can either be recognized with the naked eye, or with simple additional aids (e.g. a magnifier), or with special aids (e.g. a microscope), or purely machine-readable security structures, micro- or nanotext items of information, dynamic color effects or the like can also be provided in the area of the second item of optical information 151.

In particular, micro- or nanotext items of information can be provided with an almost continuous variation in size in the range of from 3 μm to 2 mm, preferably in the range of from 10 μm to 500 μm, further preferably in the range of from 20 μm to 150 μm.

Figure 7:
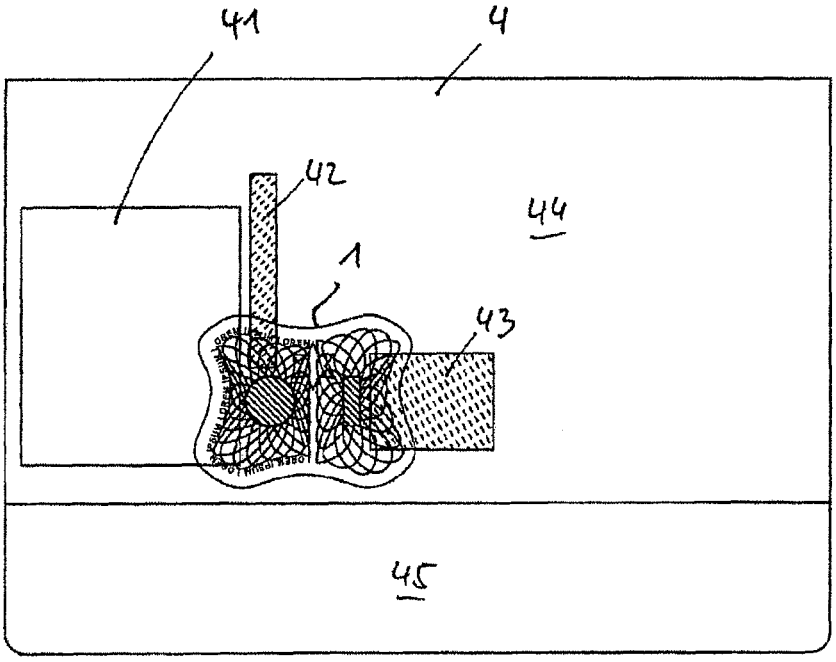
FIG. 7 An embodiment example of a security document with a multilayer body according to FIG. 6.

The multilayer body 1 can now be applied to a security document 4, for example an identity document, as represented in FIG. 7. This can take place, for example, by hot stamping or by lamination on or lamination in, back-injection molding, UV transfer (cold stamping). Laminating the multilayer body 1 into the security document 4 is also possible. The carrier can be pulled off after the application or remain on the substrate. Furthermore, the security element 4 can be protected by further applied plies or layers, for example by a protective film laminated over it. Furthermore, the security feature 4 can be transferred onto a further transfer ply in a first step and, in a next step, be transferred onto the substrate to be secured together with the transfer ply.

In the embodiment example of a security document 4 represented in FIG. 7, the multilayer body 1 is applied in such a way that it overlaps an identification photograph 41, with the result that the latter cannot be removed without the security document 4 and/or the multilayer body 1 being destroyed.

The multilayer body 1 can itself be partially overprinted in a further step with further security features 42, 43. This can take place, for example, by ink-jet printing, offset printing, letterpress printing or die stamping. The security features 42, 43 can also contain individualized items of information and ensure that the multilayer body 1 cannot be removed from the security document 4.

Furthermore, in the area 44 of the security document, the necessary personalization information for the security document 4 can be printed on. A possible method consists in printing the personalization information by means of ink-jet printing. If the printing is also to take place over the security feature, in particular water-based inks require a special receptive layer or an ink receiving layer so that the printing can dry in a sufficiently short time. Such layers consist, for example, of a swellable layer, a microporous layer or a combination of the two. Swellable layers typically consist of polyvinyl alcohol, polyvinylpyrrolidone, gelatin derivatives or cellulose ester or also of mixtures thereof. Layer thicknesses typically lie in the range of from 3 μm to 10 μm. Porous layers consist, for example, of polyvinyl alcohols with large amounts of fillers. Such layers typically have layer thicknesses of from 5 μm to 25 μm, preferably of from 5 μm to 15 μm.

Advantageously, such layers are part of the multilayer body 1, with the result that, after application onto the security document 4, they form the uppermost ply. Alternatively, such layers can also be applied after the application onto the security document 4, for example by means of intaglio printing, pad printing, screen printing or flexographic printing. As a further alternative, such layers can be applied as dry transfer ply by means of a separate transfer process, such as for example by means of hot stamping or UV transfer (cold stamping).

A further area 45 is available for affixing machine-readable data. Here, biometric data of the holder of the security document 4 can be stored, for example. In area 44, machine detectable items of information can be printed on, for example in the form of a 1D or 2D barcode. Particularly advantageously, items of information uniquely identifying the document, such as for example the document number and/or parts of the personal data, are encrypted by means of cryptographic methods and are printed onto the document as machine detectable information. The consistency of the data can then be checked by means of suitable algorithms and thus the authenticity of the entries can be verified.

It is advantageous if the document number is also introduced in the area of the multilayer body 1, i.e. overlapping with the multilayer body 1. The introduction by means of a technique which leads to the multilayer body 1 being altered irreversibly, for example by means of a laser, is particularly advantageous.

Furthermore, partial areas of the metal layers in the first and/or second area can in particular be processed by means of laser radiation after application of the multilayer body 1 onto the security document 4 and thus the metal can be removed. This is suitable, in particular, for introducing an individual identification, such as for example a number. If this processing takes place in the second partial area, the color printing becomes recognizable in the areas freed from metal, which contributes to a further increase in the security. Furthermore, by adapting the laser parameters locally only the metal layer can be removed or at the same time the color layer, with the result that within a number partial areas can be designed colored or not colored, which can be used to further increase the security. Such a processing can already take place in the multilayer body 1 before it is applied onto a substrate or only thereafter.

LIST OF REFERENCE NUMBERS

1 multilayer body
11 carrier ply
12 transfer ply
13 metal layer
131 first item of optical information
14 protective lacquer
15 partial lacquer layer
151 second item of optical information
16 partial lacquer layer
161 third item of optical information
17 partial lacquer layer
171 fourth item of optical information
18 adhesive layer
2 area of the multilayer body
3 area of the multilayer body
4 security document
41 photograph
42 security feature
43 security feature
44 area of the security document
45 area of the security document

The invention claimed is:

1. A method for the production of a multilayer body in the form of a security element, comprising the following steps:
a) producing a metal layer on a substrate;
b) partial demetalization of the metal layer to form a partial metal layer comprising a first item of optical information in a first area of the multilayer body;
c) applying a partial lacquer layer in a second area of the multilayer body to form a second item of optical information, wherein the partial lacquer layer extends at least partially beyond the metal layer;
d) structuring the partial metal layer in the second area using the partial lacquer layer as mask, wherein the partial metal layer is either selectively retained or selectively removed in the areas which are covered by the partial lacquer layer.

2. The method according to claim 1, wherein the partial demetalization in step b) takes place through etching.

3. The method according to claim 2, wherein the partial lacquer layer is an etch resist, or comprises at least one etch resist.

4. The method according to claim 3, wherein the etch resist is a lacquer that comprises:
binders;
colored or non-colored pigments and/or effect pigments;
thin-layer film systems;
cholesteric liquid crystals;
dyes; and/or
metallic or non-metallic nanoparticles.

5. The method according to claim 1, wherein before the application of the partial lacquer layer in step c), the metal layer is partially demetalized in the second area.

6. The method according to claim 5, wherein the partial demetalization of the metal layer in the second area takes place through etching.

7. The method according to claim 6, wherein, in the second area, an etching base, is printed onto the metal layer by flexographic printing.

8. The method according to claim 6, wherein, before the etching, a photoresist is applied to the second area and is exposed using an exposure mask.

9. The method according to claim 8, wherein the exposure mask is formed by a partial lacquer layer applied to the substrate before the application of the metal layer.

10. The method according to claim 6, wherein, before the etching, an etch resist is applied partially to the second area and is removed again after the etching.

11. The method according to claim 5, wherein the partial demetalization of the metal layer in the second area takes place through lift-off.

12. The method according to claim 5, wherein the partial demetalization of the metal layer in the second area takes place through laser ablation.

13. The method according to claim 5, wherein the partial demetalization of the metal layer in the second area takes place through printing of a partial oil layer before the application of the metal layer.

14. The method according to claim 1, wherein the substrate is or comprises a replication layer with a surface relief formed in a surface facing the metal layer.

15. The method according to claim 14, wherein the surface relief introduced into the replication layer forms a hologram, a linear or crossed sinusoidal diffraction grating, a linear or crossed single- or multilevel rectangular grating, a zero-order diffraction structure, an asymmetrical relief structure, a blazed grating, an isotropic or anisotropic matt structure, or a light-diffracting and/or light-refracting and/or light-focusing micro- or nanostructure, a binary or continuous Fresnel lens, a binary or continuous Fresnel freeform surface, a microprism structure or a combination structure thereof.

16. The method according to claim 14, wherein the surface relief comprises a partial area with a depth-to-width ratio of from 0.15 to 1.5, which is complementary to the first item of optical information.

17. The method according to claim 16, wherein, for the partial demetalization of the metal layer in the first area, a photoresist is applied to the metal layer and is exposed from the side of the substrate and the metal layer is then partially demetalized by etching.

18. The method according to claim 1, wherein at least one further partial lacquer layer is applied to the multilayer body to form at least one further item of optical information.

19. The method according to claim 18, wherein the at least one further partial lacquer layer comprises:

colored or non-colored pigments and/or effect pigments;
thin-layer film systems;
cholesteric liquid crystals;
dyes; and/or
metallic or non-metallic nanoparticles.

20. The method according to claim 19, wherein the colorants can be excited in the ultraviolet and/or infrared spectrum to fluorescence and/or phosphorescence in the visible spectrum.

21. The method according to claim 1, wherein the partial lacquer layer and/or the at least one further partial lacquer layer is applied by intaglio printing, flexographic printing, screen printing, pad printing, offset printing, letterpress printing, ink-jet printing and/or laser printing.

22. The method according to claim 1, wherein the partial lacquer layer and/or the at least one further partial lacquer layer is radiation-cured by UV or electron-beam radiation.

23. The method according to claim 1, wherein at least one individualization feature is applied to the multilayer body by ink-jet and/or laser printing.

24. A multilayer body in the form of a security element, wherein the multilayer body comprises a substrate, a partial metal layer and a partial lacquer layer, and wherein the partial metal layer forms, in a first area, a first item of optical information and the partial lacquer layer forms, in a second area, a second item of optical information and the partial lacquer layer is arranged in the second area in register with the partial metal layer, wherein the partial lacquer layer extends both into areas which are covered by the partial metal layer and into areas not covered by the partial metal layer.

25. The multilayer body according to claim 24, wherein the substrate is or comprises a replication layer with a surface relief, which is formed in a surface facing the partial metal layer.

26. The multilayer body according to claim 25, wherein the surface relief introduced into the replication layer forms a hologram, a linear or crossed sinusoidal diffraction grating, a linear or crossed single- or multilevel rectangular grating, a zero-order diffraction structure, an asymmetrical relief structure, a blazed grating, an isotropic or anisotropic matt structure, or a light-diffracting and/or light-refracting and/or light-focusing micro- or nanostructure, a binary or continuous Fresnel lens, a binary or continuous Fresnel freeform surface, a microprism structure or a combination structure thereof.

27. The multilayer body according to claim 25, wherein the surface relief comprises a partial area with a depth-to-width ratio of from 0.15 to 1.5, which is complementary to the first item of optical information.

28. The multilayer body according to claim 24, wherein the substrate comprises a wax layer and/or a release layer and/or a protective lacquer layer.

29. The multilayer body according to claim 28, wherein a layer thickness of the replication layer and/or of the protective lacquer layer is 0.3 μm to 3 μm.

30. The multilayer body according to claim 28, wherein a layer thickness of the wax layer and/or of the release layer is 0.01 μm to 0.3 μm.

31. The multilayer body according to claim 24, wherein the substrate comprises a releasable carrier ply made of PET.

32. The multilayer body according to claim 31, wherein a layer thickness of the carrier ply is 5 μm to 75 μm.

33. The multilayer body according to claim 24, wherein the partial metal layer consists of aluminum, copper, chromium, silver and/or gold.

34. The multilayer body according to claim 24, wherein a layer thickness of the metal layer is 10 nm to 200 nm.

35. The multilayer body according to claim 24, wherein, in the first area, a transparent protective lacquer layer made of PVC, PET, acrylate, nitrocellulose, cellulose acetobutyrate or mixtures thereof is arranged on the partial metal layer.

36. The multilayer body according to claim 35, wherein a layer thickness of the protective lacquer layer is 0.2 μm to 10 μm.

37. The multilayer body according to claim 24, wherein at least one further partial lacquer layer is provided which forms a further item of optical information.

38. The multilayer body according to claim 24, wherein a layer thickness of the partial lacquer layer and/or of the at least one further partial lacquer layer is 2 μm to 10 μm.

39. The multilayer body according to claim 24, wherein the partial lacquer layer and/or the at least one further partial lacquer layer comprises:

colored or non-colored pigments and/or effect pigments;
thin-layer film systems;
cholesteric liquid crystals;
dyes; and/or
metallic or non-metallic nanoparticles.

40. The multilayer body according to claim 39, wherein the colorants can be excited in the ultraviolet and/or infrared spectrum to fluorescence and/or phosphorescence, in the visible spectrum.

41. The multilayer body according to claim 24, wherein the first and/or second and/or further item of optical information is formed in the shape of at least one motif, guilloche pattern, symbol, image, logo or of alphanumeric characters, numbers and/or letters.

42. The multilayer body according to claim 24, wherein the first and/or second and/or further item of optical information is formed in the shape of a one- or two-dimensional line and/or dot grid, wherein the line and/or dot grid has a grid spacing of less than 300 μm and of more than 25 μm.

43. The multilayer body according to claim 24, wherein the first and/or second and/or further item of optical information comprises at least one machine-readable barcode.

44. The multilayer body according to claim 24, wherein on the side of the multilayer body facing away from the substrate, an adhesive layer, made of PVC, polyester, acrylate, cellulose ester, natural resin, ketone resin, polyamide, polyurethane, epoxy resin or mixtures thereof, is arranged.

45. The multilayer body according to claim 44, wherein a layer thickness of the adhesive layer is 0.5 μm to 25 μm.

46. A bank note, security, identity document, visa document, passport or credit card with a multilayer body according to claim 24.

* * * * *